US006286767B1

(12) United States Patent
Hui-Chen

(10) Patent No.: US 6,286,767 B1
(45) Date of Patent: Sep. 11, 2001

(54) PISTOL NOZZLE

(76) Inventor: Chao Hui-Chen, P.O. Box 453, Taichung (TW)

( * ) Notice: Subject to any disclaimer, the term of this patent is extended or adjusted under 35 U.S.C. 154(b) by 0 days.

(21) Appl. No.: 09/598,677

(22) Filed: Jun. 21, 2000

(51) Int. Cl.[7] ..... A62C 31/02

(52) U.S. Cl. ..... 239/394; 239/392; 239/437; 239/447; 239/538; 239/522; 239/526

(58) Field of Search ..... 239/390–394, 239/442, 446, 447, 525, 526, 540, 548, 561, 562, 436, 437, 538, 522

(56) References Cited

U.S. PATENT DOCUMENTS 5,566,886 * 10/1996 Wang ..... 239/394
5,598,978 * 2/1997 Wang ..... 239/394
5,772,121 * 6/1998 Wang ..... 239/394
5,823,442 * 10/1998 Guo ..... 239/394
5,873,531 * 2/1999 Wang ..... 239/394
5,992,762 * 11/1999 Wang ..... 239/394
6,113,009 * 9/2000 Chih ..... 239/394
6,164,566 * 12/2000 Hui-Chen ..... 239/394
6,196,476 * 3/2001 Wang ..... 239/394
6,224,000 * 5/2001 Wang ..... 239/394
6,230,988 * 5/2001 Chao ..... 239/394

* cited by examiner

*Primary Examiner*—David A. Scherbel
*Assistant Examiner*—Dinh Q. Nguyen

(57) ABSTRACT

A pistol nozzle is provided with a water outlet which is connected with a head seat which is in turn fastened with a water emission cover having a plurality of emission holes of various forms, meshes, and full flow holes. The water emission cover is provided therein with a water distribution disk which is provided with a plurality of through holes and guide holes. The water emission cover is provided with a plurality of ribs which are circularly arranged. The water distribution disk is provided with a plurality of round holes which are circularly arranged and are corresponding in location to the ribs. The round holes are in communication with the guide holes of the water distribution disk. The water distribution disk is joined with the inner wall of the water emission cover by a high frequency wave process.

1 Claim, 10 Drawing Sheets

PISTOL NOZZLE

FIELD OF THE INVENTION

The present invention relates generally to a sprinkling device, and more particularly to a pistol nozzle.

BACKGROUND OF THE INVENTION

As shown in FIG. 1, a prior art pistol nozzle is rather primitive in design in that it is incapable of emitting water in various ways, and that it is apt to cause the water turbulence in the course of emitting water, and further that it is susceptible to leak.

SUMMARY OF THE INVENTION

The primary objective of the present invention is to provide an improved pistol nozzle which is capable of emitting water in various ways.

It is another objective of the present invention to provided an improved pistol nozzle capable of emitting water without forming the water turbulence.

It is still another objective of the present invention to provide an improved pistol nozzle which is leakproof.

It is still another objective of the present invention to provide an improved pistol nozzle capable of sprinkling water in a relatively large area.

The features and the advantages of the present invention will be readily understood upon a thoughtful deliberation of the following detailed description of a preferred embodiment of the present invention with reference to the accompanying drawings.

BRIEF DESCRIPTION OF THE DRAWINGS

FIG. 5-1 shows a plan view of an internal side of the water emitting cover of the preferred embodiment of the present invention.

FIG. 6-1 shows a plan view of an internal side of the water distribution disk of the preferred embodiment of the present invention.

FIG. 7-1 shows another sectional schematic view of special emission holes of the water emitting cover of the preferred embodiment of the present invention.

FIG. 8-1 shows a sectional schematic view of the water distribution disk of the preferred embodiment of the present invention.

DETAILED DESCRIPTION OF THE PREFERRED EMBODIMENT

Figure 1:
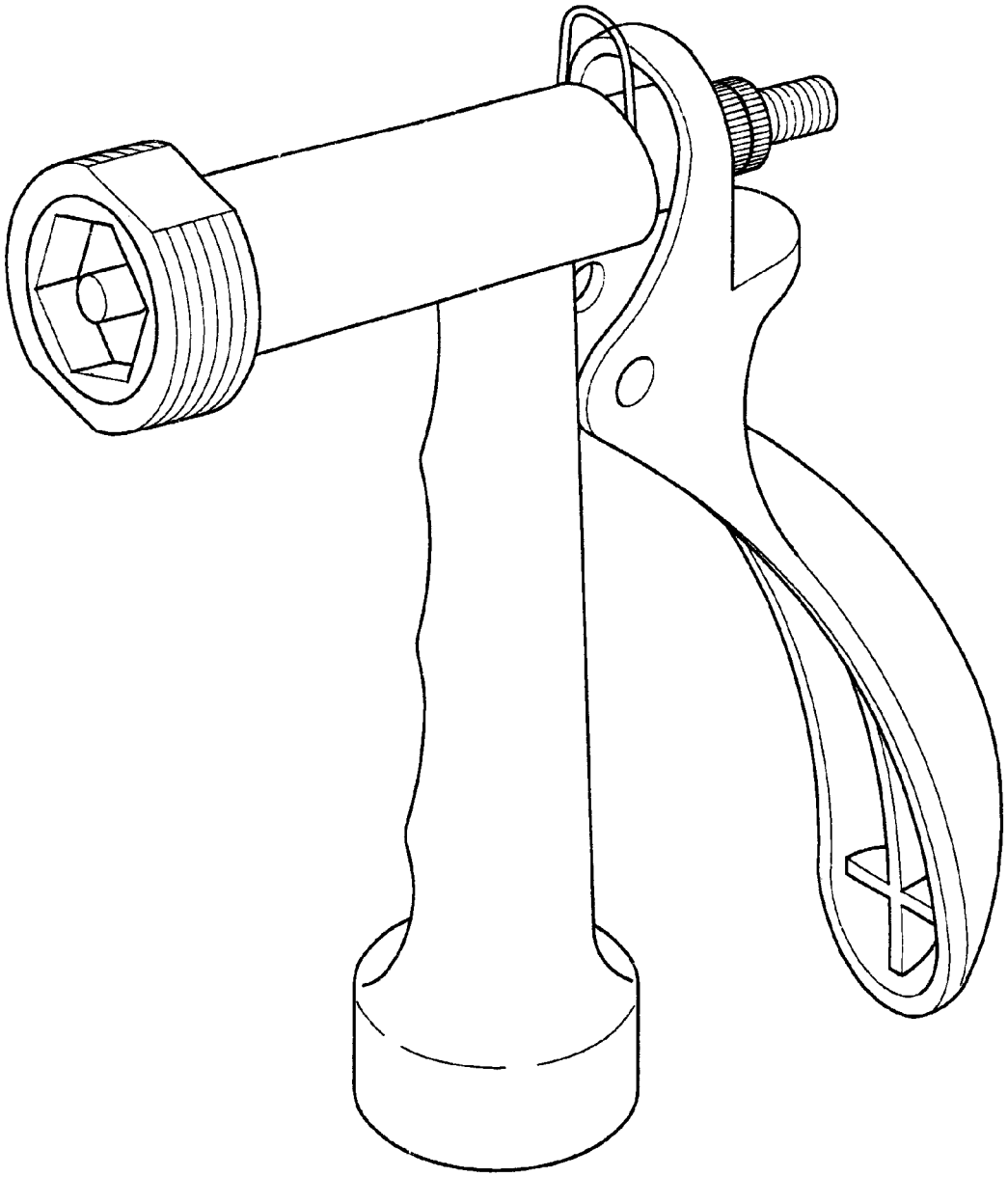
FIG.1 PRIOR ART
FIG. 1 shows a perspective view of a pistol nozzle of the prior art.
Figure 2:
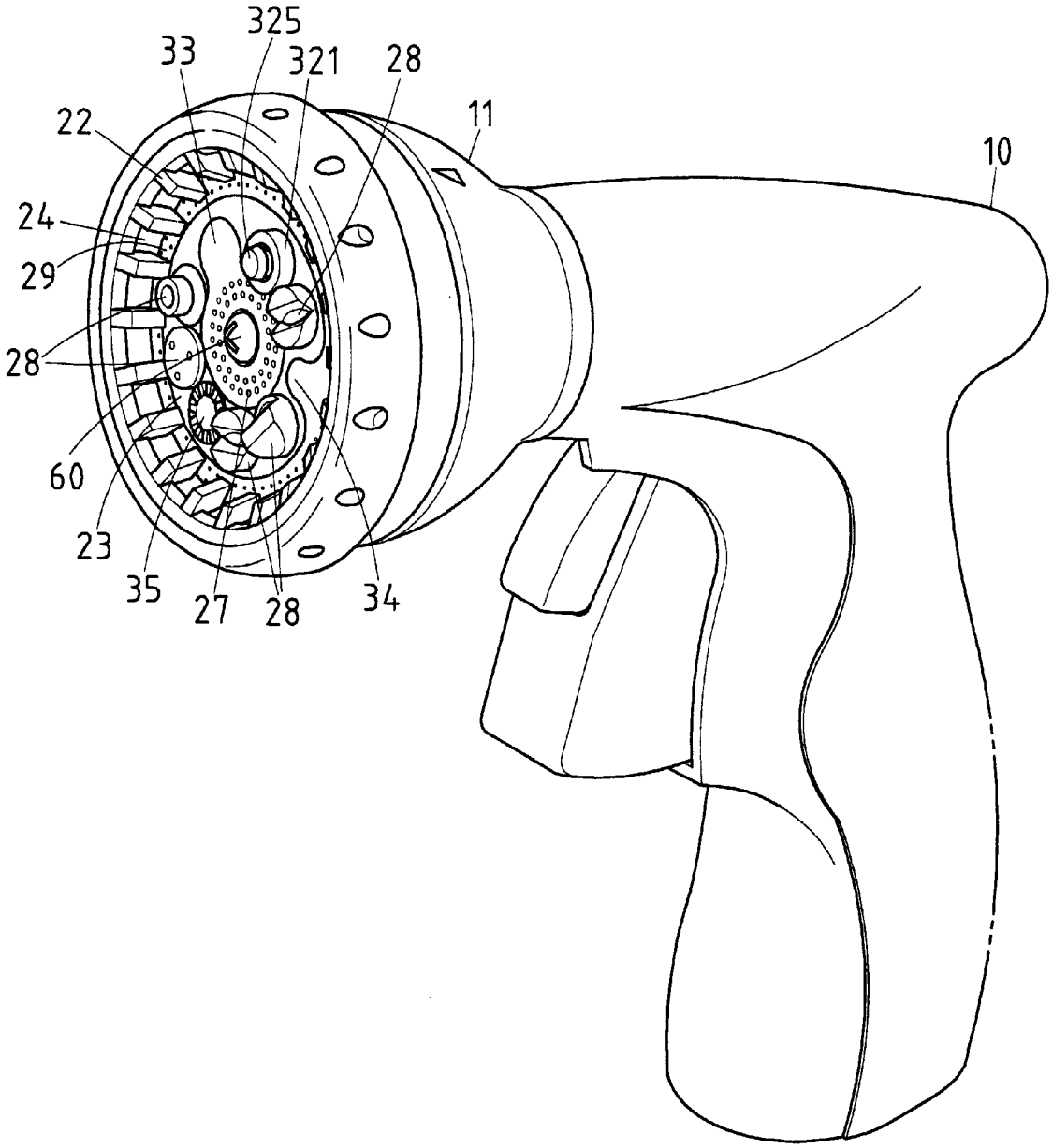
FIG. 2 shows a perspective view of the preferred embodiment of the present invention.
Figure 3:
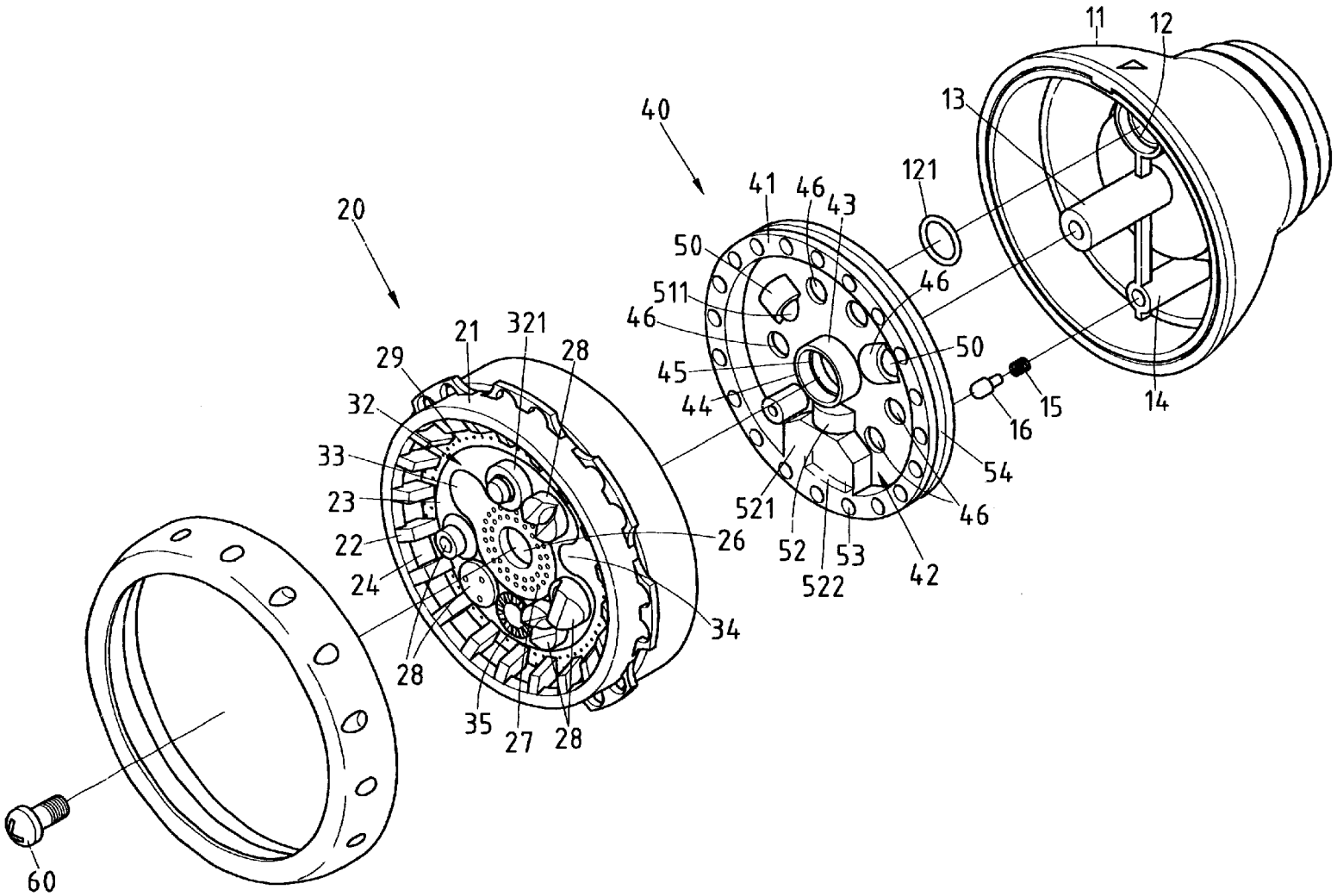
FIG. 3 shows an exploded view of the preferred embodiment of the present invention.
Figure 4:
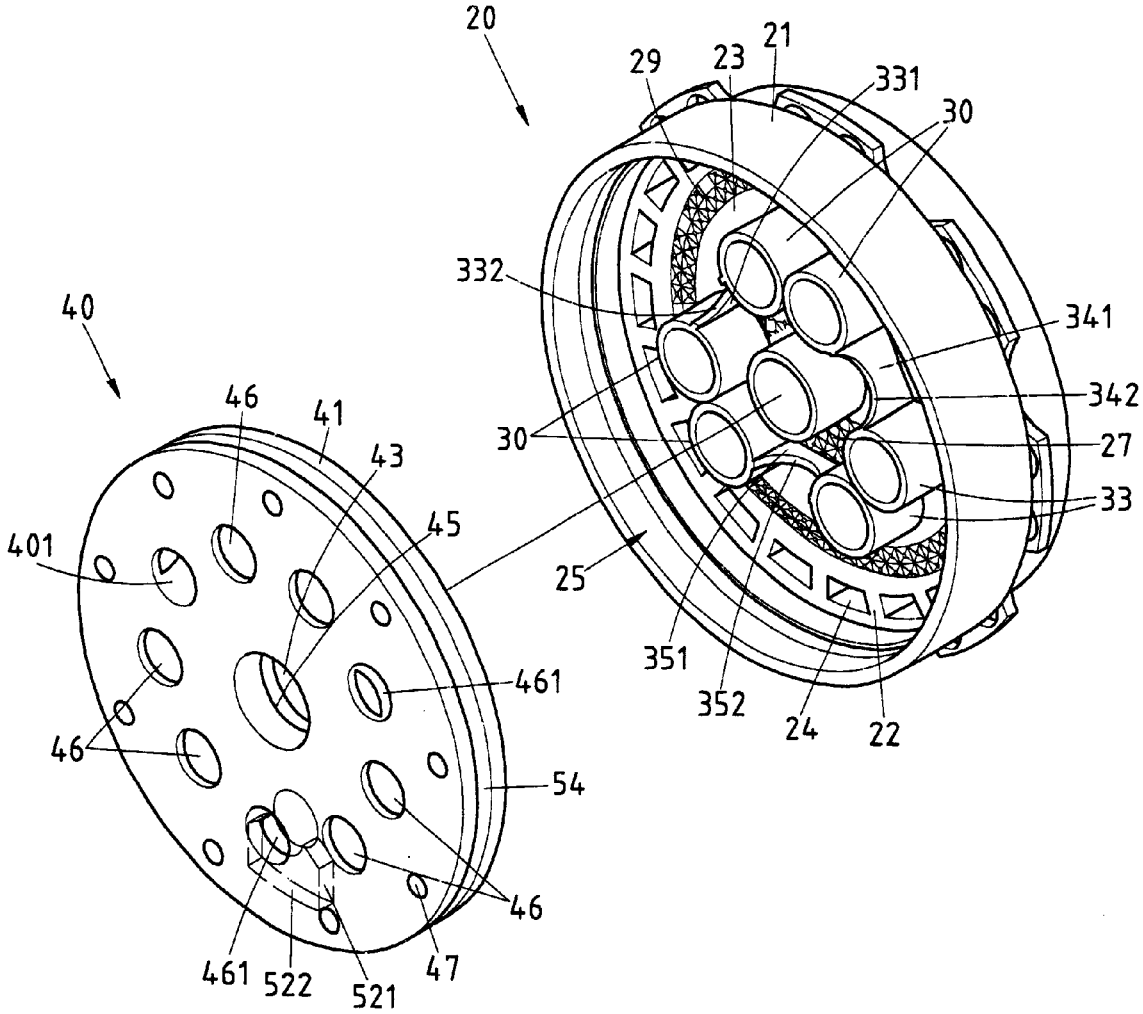
FIG. 4 shows an exploded view of a water emitting cover and a water distribution disk of the preferred embodiment of the present invention.
Figure 5:
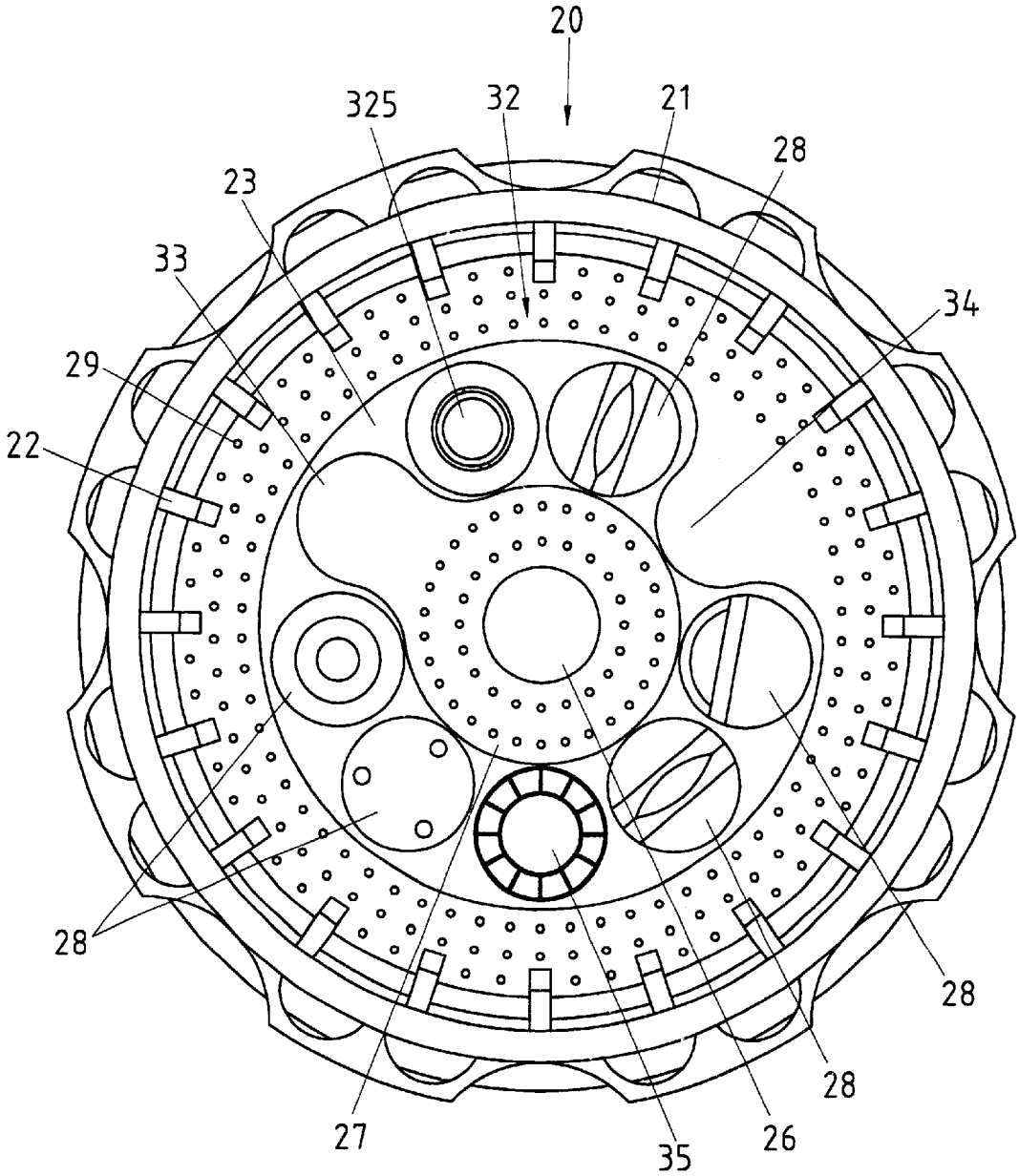
FIG. 5 shows a plan view of an external side of the water emitting cover of the preferred embodiment of the present invention.
Figures 1, 5:
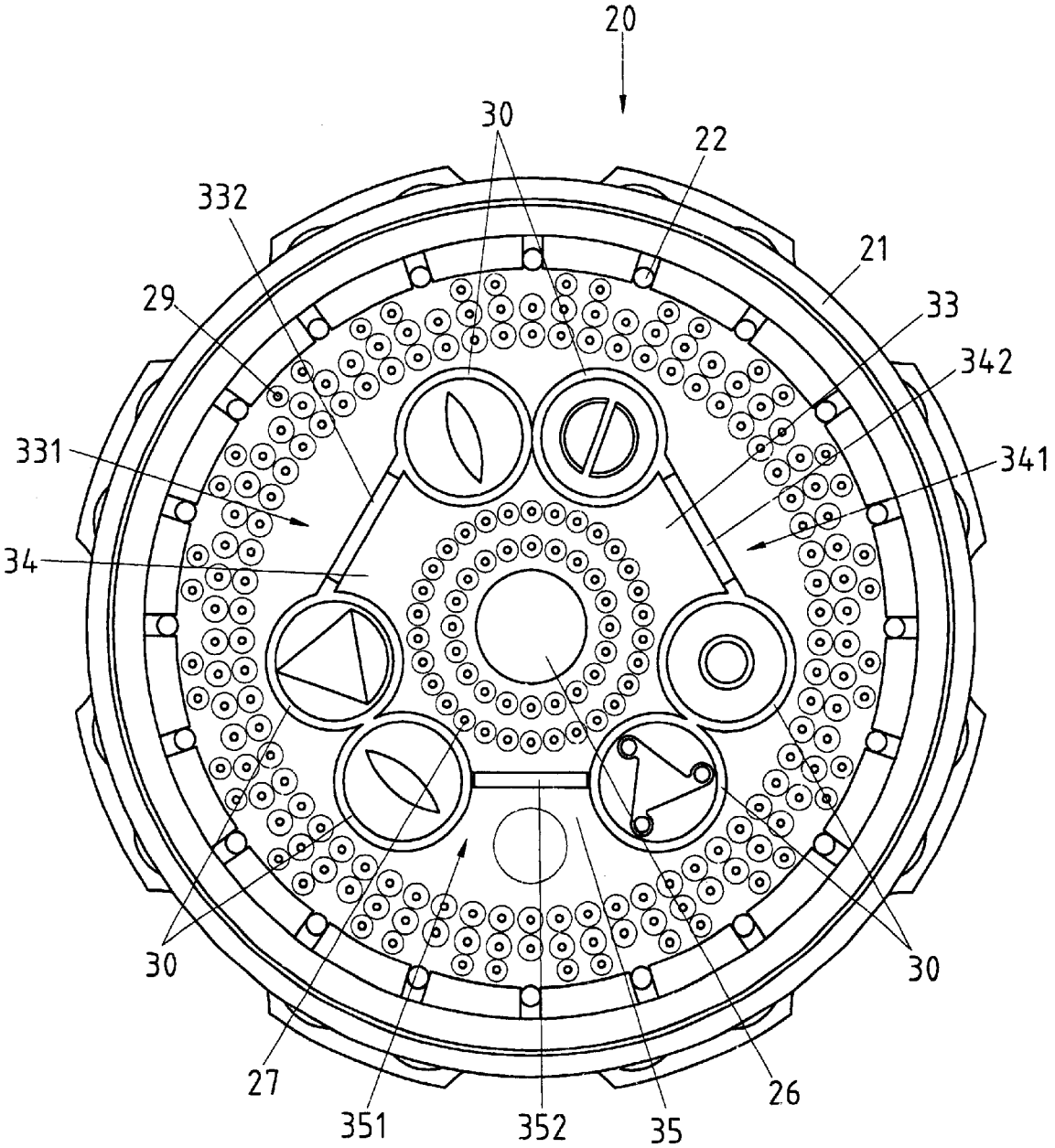
Figure 6:
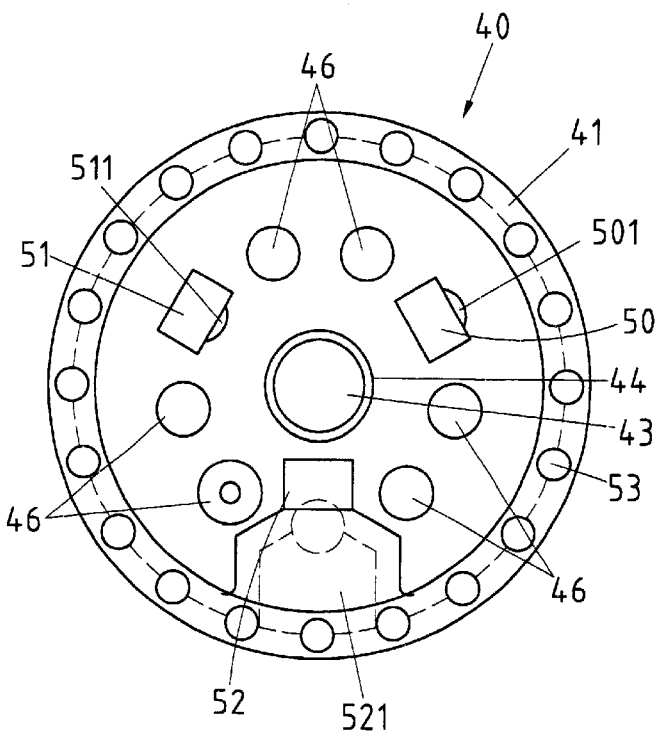
FIG. 6 shows a plan view of an external side of the water distribution disk of the preferred embodiment of the present invention.
Figures 1, 6:
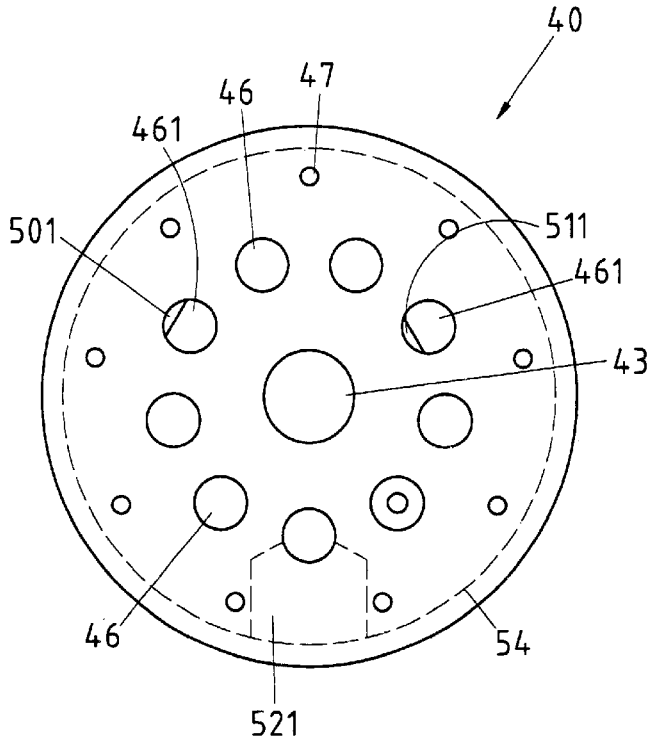
Figure 7:
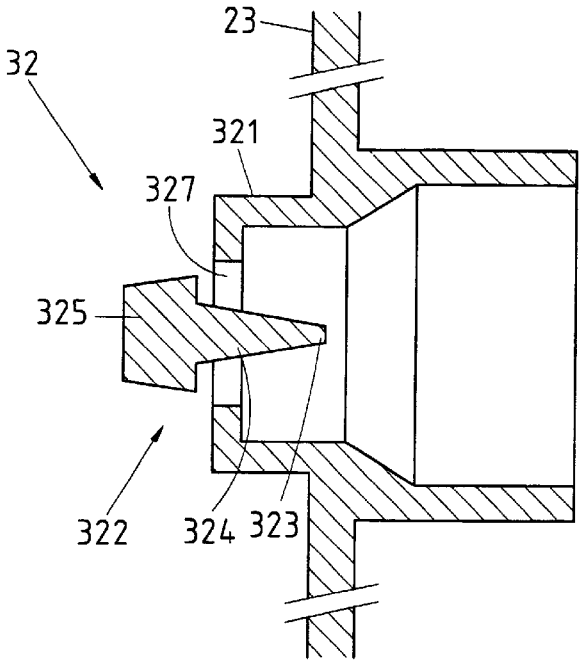
FIG. 7 shows a sectional schematic view of special emission holes of the water emitting cover of the preferred embodiment of the present invention.
Figures 1, 7:
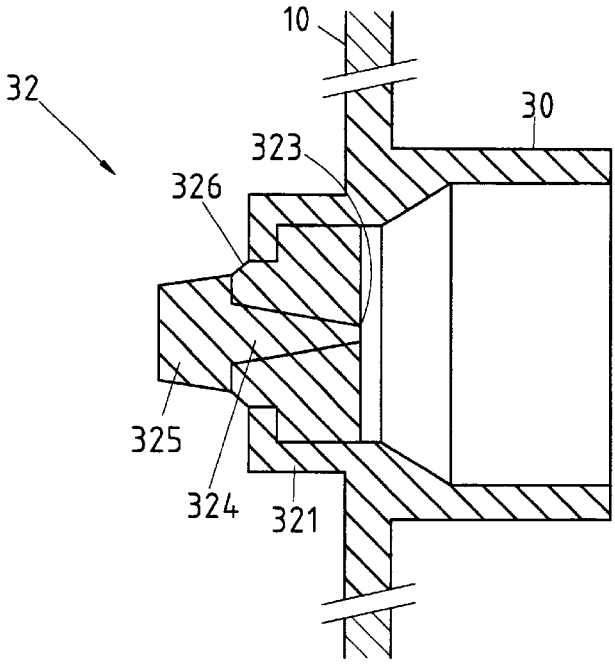

As shown in FIGS. 2~7-1, a pistol nozzle of the preferred embodiment of the present invention comprises the component parts, which are described hereinafter.

A main body 10 is provided at the front end of the top thereof with a head seat 11 fastened therewith. The head seat 11 is provided in the interior of the outer end thereof with a water outlet 12, a locating tube 13, and a fitting tube 14. The water outlet 12 is provided with a washer 121 fitted thereinto. A locating bolt 16 is fitted into the fitting tube 14 and a recovery spring 15.

A water emission cover 20 has an outer annular body 21 which is provided in the front side of the inner wall thereof with a plurality of ribs 22, which are arranged circularly at an interval and are connected with a face plate 23 smaller in diameter. The outer peripheral edge of the face plate 23 and the front side of the inner wall of the outer annular body 21 form a full flow hole 24. The inner side of the water emission cover 21 is provided with a recessed space 25. The face plate 23 is provided in the center with a through hole 26 which is in turn provided in the outer periphery with an inner annular mesh 27. The face plate is provided in the outer side with a plurality of emission holes 28 of various shapes, and an outer annular mesh 29, and two tubular bodies 30 and 31 corresponding to emission holes 28 and the through hole 26.

The emission holes 28 of the water emission cover 20 are provided with a special emission hole 32, which is formed by a protruded ring 321 and a guide body 322 which is provided with a pointed end 323 located in the protruded ring 321. The pointed end 323 is provided with a tapered rod 324, an annular body 325, a wing piece 326, and a passage 327. The water emission cover 20 is further provided with three partition areas 33, 34, and 35, each of which forms with the inner side of the face plate 23 a locating wall 331, 341, 351. The three locating walls are respectively provided with a recessed arcuate edge 332, 342, 352.

A water distribution disk 40 has an outer diameter equal to the inner diameter of the recessed space 25 of the inner side of the water emission cover 20. The water distribution disk 40 is provided in the outer side thereof with an annular side 41 and a recessed surface 42. The water distribution disk 40 is provided in the center thereof with a locating hole 43 which is in turn provided with an annular body 445 corresponding in location to the through hole 26 of the face plate of the water emission cover 20. The annular body 44 is provided in the inner wall with an arresting ring 45 smaller in inner diameter. The water distribution disk 40 is provided with a through hole 46 corresponding in location to said tubular body 30 and smaller in inner diameter than said tubular body 30. The water distribution disk 40 is further provided in the inner side with a plurality of recessed edges 47 which are arranged circularly. The water distribution disk 40 is fastened with the face plate of the water emission cover 20 by a high frequency wave process such that the wall of the water distribution disk 40 is intimately attached to the inner wall of the recessed space 25, and that the water distribution disk 40 and the water emission cover 20 are disposed on the outer end of the head seat 11, and further that the locating tube 13 is engaged with a bolt 60 via the locating hole 43 of the water distribution disk 40 and the through hole 26 of the water emission cover 20. The water distribution disk 40 is actuated by the water emission cover 20 to turn such that the through hole 46 of the water distribution disk 40 is in communication with the water outlet 12 of the head seat 11, thereby enabling water to be emitted from the emission holes 28. When the through hole 40 of the water distribution disk 40 is aligned with the water outlet 12 of the head seat 11, the water distribution disk 40 and the head seat 11 are located by the locating bolt 16.

The water distribution disk 40 is provided in the outer side with three protruded arcuate bodies 50, 51 and 52, which are corresponding in location and size to the recessed arcuate edges 332, 342 and 352 of the locating walls 331, 341 and 351 of the inner side of the face plate 23 of the water emission cover 20. The first arcuate body 50 is provided with a guide hole 501 facing the annular body 44 of the distribution disk 40. The third arcuate body 52 has one end which is provided with a protruded block 521 which becomes gradually greater in the direction toward the annular side 41 of the outer periphery of the water distribution disk 40. The protruded block 521 is hollow and provided with a guide hole 552. The arcuate bodies 50, 51 and 52 are provided with a guide slot 461 in communication with the guide holes 501, 511 and 522. When the outer side of the water distribution disk 40 is fastened with the inner side of the face plate 23 of the water emission cover 20, the full flow hole 24 of the face plate 23 is obstructed by the annular side 41 of the water distribution disk 40. The arcuate bodies 50, 51, and 52 of the water distribution disk 40 are fitted into the recessed arcuate edges 332,342, and 352 of the locating walls 331, 341, and 351 of the face plate 23. The tubular bodies 30 and 31 of the inner side of the face plate 23, and the locating walls 331, 341 and 351 are in intimate contact with the outer side of the water distribution disk 40. The through hole 46 of the water distribution disk 40, the guide slot 461, and the locating hole 43 are in communication with the tubular bodies 30 and 31. The guide hole 501 of the first arcuate body 50 of the water distribution disk 40 is in communication with the outer annular mesh 29 of the water emission cover 20. The guide hole 511 of the second arcuate body 51 is in communication with the inner annular mesh 27 of the water emission cover 20. The guide hole 522 of the third arcuate body 52 is in communication with the full flow hole 24 of the water emission cover 20.

The present invention is characterized by the water distribution disk 40 which is provided in the annular side 41 with a plurality of round holes 53 which are circularly arranged and are corresponding in location to the ribs 22 of the water emission cover 20. The round holes 53 are in communication with the guide hole 522 of the water distribution disk 40 by the annular slot 54 of the water distribution disk 40. The water distribution disk 40 is fastened with the water emission cover 20 by the high frequency wave process.

Figure 8:
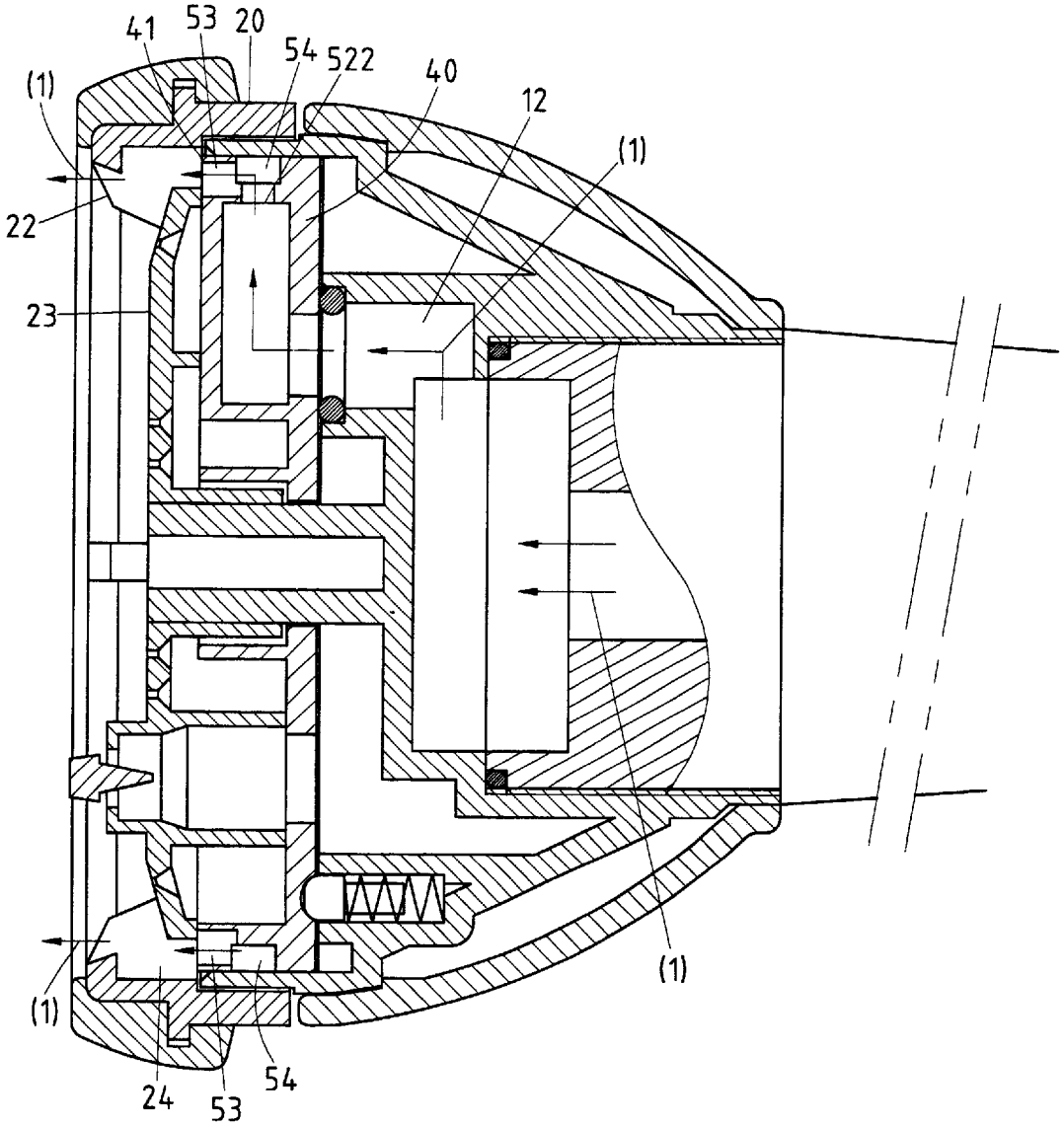
FIG. 8 shows a sectional schematic of the emission of water via a full emission hole of the preferred embodiment of the present invention.
Figures 1, 8:
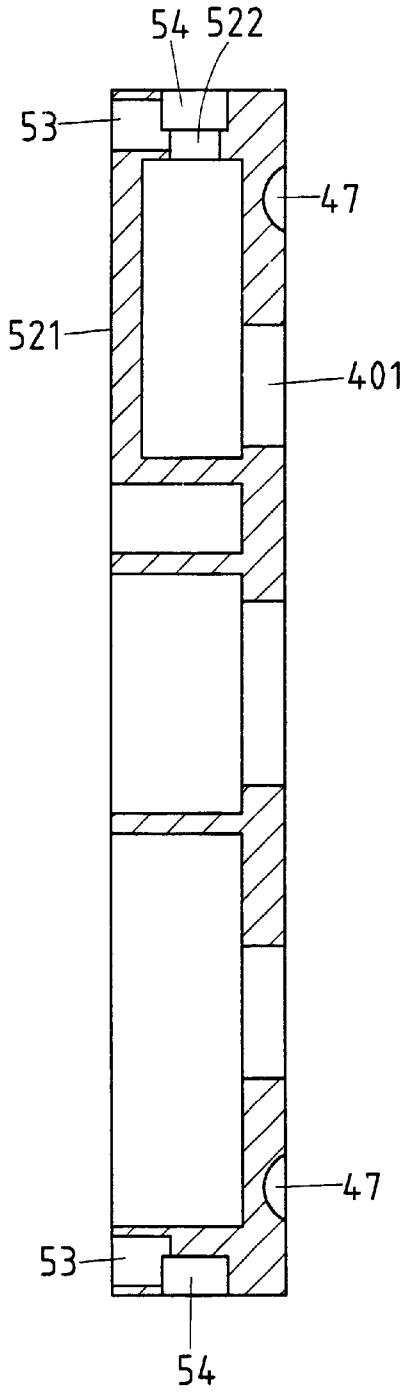

As shown in FIGS. 8 and 8-1, a water flow 1 is guided into the guide hole 522 via the through hole 461 of the water distribution disk 40. The water flow 1 is further guided into the full flow hole 24 of the water emission cover 20 via the annular slot 54 of the water distribution disk 40 and the round holes 53 of the annular side 41 of the water distribution disk 40. In light of the water distribution disk 40 being fastened with the water emission cover 20 by the high frequency wave process, the water flow 1 can not flow in reverse into the interior of the head seat 11, thereby allowing the water flow 1 to be emitted from the full flow hole 24. In light of the round holes 53 being aligned with the ribs 22 of the water emission cover 20, the water flow 1 is collided with the ribs 22 to spread out.

What is claimed is:

1. A pistol nozzle comprising:

a main body provided at a front end of a top thereof with a head seat fastened therewith, said head seat provided in an interior with a water outlet, a locating tube, and a fitting tube, said water outlet provided with a washer fitted thereinto, said fitting tube provided with a locating bolt which is fitted into said fitting tube and a recovery spring;

a water emission cover having an outer annular body which is provided in a front side of an inner wall thereof with a plurality of ribs which are circularly arranged at an interval and are connected with a face plate, said face plate provided with a full flow hole which is formed by a peripheral edge of said face plate and a front side of an inner wall of said outer annular body, said water emission cover provided in an inner side with a recessed space, said face plate being provided in a center thereof with a through hole which is in turn provided in an outer periphery with an inner annular mesh, said face plate provided in an outer side thereof with a plurality of emission holes of various shapes, and an outer annular mesh, and two tubular bodies corresponding in location to said emission holes and said through hole of said face plate, said emission holes being provided with a special emission hole which is formed by a protruded ring and a guide body having a pointed end, said pointed end being provided with a tapered rod, an annular body, a wing piece, and a passage, said water emission cover further provided with three partition areas, each of which forms with an inner side of said face plate a locating wall which is provided with a recessed arcuate edge; and a water distribution disk having an outer diameter equal to an inner diameter of said recessed space of the inner side of said water emission cover, said water distribution disk provided in an outer side thereof with an annular side and a recessed surface, and in a center thereof with a locating hole which is in turn provided with an annular body corresponding in location to said through hole of said face plate of said water emission cover, said annular body being provided in an inner wall thereof with an arresting ring, said water distribution disk being further provided with a through hole corresponding in location to said tubular body, and in an inner side with a plurality of recessed edges arranged circularly, said water distribution disk being fastened with said face plate of said water emission cover such that said water distribution disk is intimately attached with the inner wall of said recessed space, and that said water distribution disk and said water emission cover are disposed on an outer end of said head seat, and further that said locating tube is engaged with a bolt via said locating hole of said water distribution disk and said through hole of said water emission cover, said water distribution disk being actuated by said water emission cover to turn such that said through hole of said water distribution disk is in communication with said water outlet of said head seat so as to enable water to be emitted from said emission holes, said water distribution disk and said head seat being located by said locating bolt at such time when said through hole of said water distribution disk is aligned with said water outlet of said head seat, said water distribution further provided in the outer side with a first protruded arcuate body, a second protruded arcuate body, and a third protruded arcuate body, which are respectively corresponding in location and size to said recessed arcuate edges of said locating walls of the inner side of said face plate of said water emission cover, said first arcuate body provided with a guide hole facing said annular body of said water distribution disk, said third arcuate body provided in one end thereof with a protruded block which becomes gradually greater in diameter in the direction toward said annular side of said water distribution disk, said protruded block being hollow and provided with a guide hole, said protruded arcuate bodies provided with a guide slot in communication with said guide holes of said arcuate bodies, said full flow hole of said face plate of said water emission cover being obstructed by said annular side of said water distribution disk at the time when the outer side of said water distribution disk is fastened with the inner side of said face plate of said water emission cover, said arcuate bodies of said water distribution disk being fitted into said recessed arcuate edges of said locating walls of said face plate, said tubular bodies of said inner side of said face plate and said locating walls being in an intimate contract with said outer side of said water distribution disk, said through hole of said water distribution disk, said guide slot, and said locating hole being in communication with said tubular bodies, said guide hole of said first arcuate body of said water distribution disk being in communication with said outer annular mesh of said water emission cover, said guide hole of said second arcuate body being in communication with the inner annular mesh of said water emission cover, said guide hole of said third arcuate body being in communication with said full flow hole of said water emission cover;

wherein said water distribution disk is provided in said annular side with a plurality of round holes whereby said round holes are circularly arranged and are corresponding in location to said ribs of said water emission cover, said round holes being in communication with said guide hole of said water distribution disk, said water distribution disk being fastened with said water emission cover by a high frequency wave process.

* * * * *